United States Patent [19]

Gowan, Jr.

[11] Patent Number: 4,461,646

[45] Date of Patent: Jul. 24, 1984

[54] PROCESS FOR FOAM LOWERING IN DISPERSED ROSIN SIZE

[75] Inventor: John W. Gowan, Jr., Mt. Pleasant, S.C.

[73] Assignee: Westvaco Corporation, New York, N.Y.

[21] Appl. No.: 487,338

[22] Filed: Apr. 21, 1983

[51] Int. Cl.[3] ..... C08L 93/04; C09F 1/04

[52] U.S. Cl. ..... 106/238; 260/101

[58] Field of Search ..... 106/236, 238; 252/358, 252/321; 260/101

[56] References Cited

U.S. PATENT DOCUMENTS

| | | | |
|---|---|---|---|
| 1,947,498 | 2/1934 | Scholz | 252/321 |
| 2,199,206 | 4/1940 | Maters et al. | 252/358 |
| 2,873,203 | 2/1959 | Hopkins et al. | 106/238 |
| 4,071,375 | 1/1978 | Ishibe et al. | 106/238 |
| 4,267,099 | 5/1981 | Okumichi et al. | 260/101 |
| 4,309,338 | 1/1982 | Okumichi et al. | 260/101 |

FOREIGN PATENT DOCUMENTS 1113248 5/1968 United Kingdom .

*Primary Examiner*—Theodore Morris

*Attorney, Agent, or Firm*—Terry B. McDaniel; Richard L. Schmalz

[57] ABSTRACT

A series of inorganic salts are disclosed for their efficacy in lowering surfactant requirements and foam in aqueous dispersed rosin size. The salts are best employed as additives to the surfactant prior to addition of surfactant to molten rosin during preparation of the aqueous dispersion. Selected chlorides, fluorides, nitrates and sulfates of aluminum, calcium, cobalt, lead, magnesium, sodium and tin are disclosed as being effective within a range of about 0.01% to 0.1% by weight of rosin at a surfactant level of about 3.5%. Aluminum nitrate at a level of 0.04 to 0.055% by weight of the rosin, at a surfactant level of 3.5%, is preferred.

10 Claims, No Drawings

PROCESS FOR FOAM LOWERING IN DISPERSED ROSIN SIZE

BACKGROUND OF THE INVENTION

This invention relates to a process for preparing aqueous dispersions of rosin-base materials, and more particularly to a process for preparing aqueous dispersed size of lowered surfactant requirement and tendency to foam.

Cellulose fiber products such as paper and paperboards are produced from an aqueous slurry of cellulose fibers containing sizing agents admixed therewith. These sizing agents generally comprise aqueous dispersions of rosin, especially fortified rosin, which is utilized to modify the surface of the paper to control water penetration.

The present invention relates to a process for improving the properties of dispersed rosins size produced by the inversion method wherein a dispersant and water are mixed together to form a dispersion and are added to a molten rosin-base material to form a dispersion comprising a continuous phase of the rosin and a dispersed phase of the water, and to the dispersion water is added to invert the dispersion to the contemplated aqueous dispersion comprising a dispersed phase of the rosin and a continuous phase of the water.

Attention is directed to the disclosure of related U.S. Pat. Nos. 4,267,099 and 4,309,338 to Okumichi et al for an in depth discussion of a method of preparing a dispersed rosin size by the inversion method.

Okumichi et al provide a process for preparing an aqueous dispersion of a rosin-base material by the inversion method characterized by reduced foaming properties achieved by use of at least one of the dispersants disclosed and claimed therein. While dispersed rosin size prepared in accordance with Okumichi et al and particularly sizes produced with a dispersant selected from the salts of sulfuric acid half ester of the formula II, referred to by Okumichi et al as "sulfates" provides dispersed rosin size of reduced foaming properties the size still tended to produce excessive foam under conditions normally encountered in some paper making machines.

Okumichi et al thus approached the problem of lowering the tendency of a dispersed rosin sized foam by specifically tailoring the dispersant, or surfactant, albeit they do recognize the obvious expedient of lowering the surfactant level in the size to lower the tendency of the size to foam. Unfortunately, a simple lowering of surfactant level is not practicable because surfactant level is tied to the very ability to produce a dispersion.

Kawatani et al, see Japanese Kokai No. 79 58,759 comprises a disclosure that is representative of another approach to lowering the tendency of aqueous rosin dispersions to foam through the use of internal foam depressors. Kawatani et al teach the use of simple aliphatic acids, e.g., caproic, caprylic, lauric, or myristic, for this purpose. This method of foam lowering is unappealing because the amount of rosin available for sizing is reduced, contaminates with unknown effects are introduced, and the basic problem of inefficient surfactant usage is neglected.

SUMMARY OF THE INVENTION

In the practice of the present invention a series of inorganic salts are disclosed for their efficacy in lowering surfactant requirements and foam in aqueous dispersed rosin size. The salts are best employed as additives to the surfactant prior to addition of the surfactant to the molten rosin during preparation of the aqueous dispersion such as by the inversion method. The practice of the present invention enables the provision of dispersed rosin size showing less foaming tendency with relatively little loss of other desirable properties, particularly sizing efficiency, mechanical or sheet stability, and settling stability. The improved foam characteristics of dispersed rosin size produced in accordance with this invention are also evident from a consideration of the nature of the foam itself, i.e., the foam bubbles tend to be larger and more easily broken, which effect may in the final analysis be more important than absolute foam level. The equilibrium distribution of sufactant between rosin and water is also a factor influencing foam, as well as the ability to make a dispersion. This distribution is inexorably tied to the ability to use less surfactant.

With the foregoing in mind it will be seen that the principal object of the present invention is the provision of a process for lowering the tendency for dispersed rosin size to foam with as little loss of other desirable properties as possible.

It is another object of the present invention to provide dispersed rosin size of a lower surfactant level by effecting the equilibrium distribution of surfactant between rosin and water, which is also a factor influencing foam, as well as the ability to make a dispersion.

It is a further object of the present invention to reduce the susceptibility to foaming of aqueous dispersions of rosin-base materials generally prepared in accordance with the teaching of Okumichi et al U.S. Pat. No. 4,267,099 and particularly dispersions produced in accordance therewith utilizing the "sulfates" of formula II.

It is a still further object to provide for foam lowering in dispersed rosin size by the utilization of selected chlorides, fluorides, nitrates and sulfates of aluminum, calcium, cobalt, lead, magnesium, sodium and tin.

It is another object of the present invention to provide a group of inorganic salts characterized by their ability to permit lower surfactant usage in dispersed rosin sizes with attendant changes in the nature of foam produced with the size and wherein the use of aluminum nitrate provides a reproducability of improved results over a wide range of salt levels.

The disclosure of U.S. Pat. No. 4,309,338 to Okumichi et al, or the substantially identical disclosure of related U.S. Pat. No. 4,267,099 to Okumichi et al are herein incorporated by reference for a teaching of a process for preparing, by an inversion method, size comprising an aqueous dispersion of rosin-base materials which are improved in accordance with the present invention by the addition of inorganic salts to the dispersant or surfactant "sulfates" of formula II as disclosed and claimed in the '099 patent to Okumichi et al. Reference is made to U.S. Pat. No. 4,071,375 for a disclosure of fortified rosins as well as a process for their preparation.

Dispersed size for carrying forth the specific examples set forth hereinafter was produced on a laboratory scale by the following procedure it being understood that the rosin fortification procedure is not set forth and in this latter regard the disclosure of U.S. Pat. No. 4,071,375 may be referred to for a known procedure for fortification of rosin such as with fumaric acid. 600 g fortified rosin is charged into a 2 liter resin kettle and the rosin is heated to a temperature of about 165° C. and then cooled to a temperature of about 135° C. and maintained at such temperature for a minimum of five minutes before adding surfactant-salt. The surfactant-salt is prepared by diluting an amount of surfactant corresponding to the desired percentage level relative to the rosin, by weight, which surfactant is then diluted to in the order of about 18% solids. The salt as appropriate is added to the dilute surfactant and the surfactant added slowly such as at a rate in the order of 6 ml per minute. The temperature in the kettle normally will drop below 100° C. during this addition and a temperature in the order of about 97°-99° C. should be maintained throughout addition of all surfactant. After all surfactant has been incorporated the rosin-surfactant-salt is stirred for thirty minutes while maintaining the temperature in the order of about 97°-99° C. after which water addition is commenced. In the first water addition, 65°-95° C. water is added at the rate of 6 ml per minute to adjust the solids to 75%. Stirring of the mixture is then continued for thirty minutes while maintaining the temperature in the order of about 97°-99° C. A second addition of water is then commenced at a slightly faster rate in the order of about 10 ml per minute to adjust the solids content to about 47% while maintaining the temperature in the order of about 97°-99° C. It will be noted that inversion occurs approximately two thirds of the way through this second addition and a temperature decrease of about 1° C. will be observed at the point of inversion. After the second addition of water is completed the mantle is dropped and all heat to the kettle is cut off. The dispersion in the kettle is allowed to cool to below 60° C. before the addition of a third aliquot of water which 20°-35° C. water is added at a rate in the order of about 22 ml per minute to adjust the dispersion to 35% solids.

All salts employed are reagent grade material and are commercially available hydrates. Distilled water was employed unless otherwise specified. Rosin adducts were either produced in the laboratory or pilot plant generally as set forth in the above discussed procedure, or were plant produced commercially available materials where set forth. Particle diameters and sigmas were determined using a Nicomp Laser Light scattering instrument.

The surfactants employed, other than in comparative Examples, are those in accordance with the dispersants disclosed and claimed in U.S. Pat. No. 4,267,099 as being selected from the group consisting of (b):

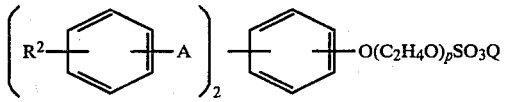

wherein $R^2$ is hydrogen or lower alkyl, A is straight-chain or branched-chain alkylene having 2 to 3 carbon atoms, p is an integer of 4 to 25, and Q is a monovalent cation.

The surfactant in accordance with U.S. Pat. No. 3,267,099 utilized in carrying out the tests set forth in the specific examples comprises formula II of the patent wherein $R^2$ is hydrogen and A is a branched-chain alkylene having 3 carbon atoms, p is 13 and Q is a monovalent cation, for example, lithium, sodium, potassium, cesium and like alkali metal ions, ammonium ions derived from ammonia and amines, etc. It will be appreciated that all surfactants within the scope of formula II of U.S. Pat. No. 4,267,099 are suitable for carrying forth the present invention.

The required amount of the appropriate salt, based on weight of rosin, was dissolved in a minimum amount of water and added to undiluted surfactant. The surfactant was further diluted to 18% solids. When preparing a dispersion wherein 0.044% aluminum nitrate is used with 600 gms rosin, 0.264 gms aluminum nitrate monohydrate was dissolved in 25 ml water. The water was considered part of the surfactant dilution water and added directly to the undiluted surfactant.

Foam was measured on a modified Betz dynamic defoamer at either room temperature or 52° C. The size sample (50 microliters) was added to 100 ml water containing 0.035 gm Ca and 0.012 gm Mg (total hardness 300 ppm). Alum (2 ml 1% solution) was added. The solution was circulated and the highest form height recorded. After 15-30 seconds the foam generally collapsed to a lower level which was recorded as the second number in the series. If no foam collapse was noted, only the higher number was reached. It should be noted that foam results are highly variable and are best taken for comparative purposes within tables. In some cases only the highest foam value is reported. Mechanical stability measurements have similar caveats. The most reliable means of interpreting mechanical stability is as a relative measurement.

Float tests were performed. A 50/50 hardwood/softwood pulp blend of Wickliffe baled pulp was beaten to 75 seconds Williams Slowness. The pulp, 2000 ml of a 1.2% slurry in deionized water, was treated with 1.8 ml of a 1% alum solution followed 5 minutes later with 1.2 ml of a 1% size solution. The slurry was stirred 10 minutes and poured through a funnel into the center of a two liter graduated cylinder. The slurry was left undisturbed. The clear volume at the top or bottom of the cylinder was recorded after 20 and 40 minutes and overnight.

Handsheets were prepared according to TAPPI Standards T200 OS-70 and T205 OS-71. The pulp was beaten to 75 seconds Williams Slowness. A 50/50 hardwood/softwood blend of Wickliffe baled pulp was used. Alum at 30 pounds/ton and size at 20 pounds/ton were added. The pulp was conditioned at 50% relative humidity for at least 48 hours before use.

Rosin adduct samples were chromatographed on a 10% DEGS on 80/100 Chrom WAW support in a $\frac{1}{8}''\times 6'$ SS column. Nitrogen was employed as carrier gas at 25 ml/minute. Detection was by flame ionization. The sample was injected as the tetramethylammonium salt in benzene. Injection and detection temperatures were both 320° C. Initial column temperature was 100° and was held there for 3 minutes, after which the temperature was raised to 185° at the rate of 8.5°/minute. Top temperature was held 65 minutes.

Before setting forth specific examples in accordance with the invention, baseline data were developed. Table I shows particle size and distribution, mechanical stability, foam, and sizing data for Monsize®, Neuphor®, and Stafor® which comprise trademarks of Monsanto Chemical Company, Hercules Powder Company and Westvaco Corporation, respectively, for their dispersed rosin sizes.

TABLE I

CHARACTERIZATION OF COMMERCIAL DISPERSE SIZES

| | Diameter (μm) | σ | Mechanical Stability (Relative) | Hercules Size Test (Seconds) | Foam (ml)* |
|---|---|---|---|---|---|
| Stafor ® | 0.25 | 0.023 | 10 | 110 | 50/25 |
| Monsize ® | 0.29 | 0.13 | 1.0 | 80 | 15/5 |
| Neuphor ® | 0.26 | 0.099 | 0.23 | 111 | 40/20 |

*Highest foam level/Foam level after 30 seconds.
σ = The statistical error involved in the computation of the average particle diameters.

Table II lists data developed with various surfactant and sodium chloride levels. The surfactant in all instances is that of U.S. Pat. No. 4,267,099, formula II. These samples were made with Westvaco Rosin S fortified with 1% formaldehyde and 9% fumaric acid. The rosin softening point was 103.6° C. the effect of the rosin fortification on particle size and mechanical stability will be dealt with below.

TABLE II

DISPERSE SIZE PRODUCED WITH VARYING SURFACTANT AND SODIUM CHLORIDE LEVELS

| Ex. No. | Surfactant Level (% on wt. of rosin) | Sodium Chloride (% on wt. of rosin) | Particle Diameter (μm) | σ | Mechanical Stability (Minutes at 46°C.) | Foam (ml) (Highest Level) |
|---|---|---|---|---|---|---|
| 1. | 4.5 | 0.044 | 0.25 | 0.0225 | 28.9 | 50 |
| 2. | 4.0 | 0.044 | 0.29 | 0.0773 | 336.0 | 55 |
| 3. | 4.0 | 0.1 | 0.39 | 0.2170 | 62.3 | 35 |
| 4. | 3.5 | 0.044 | 0.40 | 0.276 | 26.0 | 35 |
| 5. | 3.5 | 0.10 | 0.32 | 0.145 | 104.0 | 40 |
| 6. | 3.5 | 0.15 | 0.32 | 0.073 | 53.0 | 30 |
| 7. | 3.0 | 0.044 | | | No Inversion | |
| 8. | 3.0 | 0.1 | | | No Inversion | |
| 9. | 3.0 | 0.15 | | | No Inversion | |

Improvements could be seen, particularly with regard to foam. However, it will be seen that particle size and distribution suffered. Even with the loss in those areas, foam still remained higher than Monsize ®, see Table I.

Magnesium chloride was utilized in place of sodium chloride. Somewhat better results were obtained. In Table III, the results with magnesium chloride are shown. The rosin adducts and surfactant used are the same as used in the sodium chloride studies.

TABLE III

EFFECT OF MANGESIUM CHLORIDE ON DISPERSE SIZE CHARACTERISTICS

| Ex. No. | Surfactant Level (% on Rosin | Magnesium Chloride (% on Rosin | Particle Diameter (μm) | σ | Mechanical Stability (Minutes at 46° C.) | Foam (ml) (Highest |
|---|---|---|---|---|---|---|
| 10. | 4.0 | 0.044 | 0.32 | | 75.4 | 40 |
| 11. | 3.5 | 0.044 | 0.39 | 0.08 | 65.4 | 25 |

TABLE III-continued

EFFECT OF MANGESIUM CHLORIDE ON DISPERSE SIZE CHARACTERISTICS

| Ex. No. | Surfactant Level (% on Rosin | Magnesium Chloride (% on Rosin | Particle Diameter (μm) | σ | Mechanical Stability (Minutes at 46° C.) | Foam (ml) (Highest |
|---|---|---|---|---|---|---|
| 12. | 3.0 | 0.044 | 0.32 | 0.08 | 87.3 | 25 |
| 13. | 3.0 | 0.1 | 0.35 | | 86.1 | 20 |
| 14. | 2.5 | 0.044 | 0.39 | 0.2 | 43.1 | 20 |
| 15. | 2.5 | 0.1 | 0.6 | 0.15 | 89.6 | 15 |

As in the case of sodium chloride, an increase in particle size is seen. The drop in foam is much more pronounced, however. At the 2.5% surfactant level, the foam is approaching that of Monsize ®, and mechanical stability is maintained.

The effect of mixtures of sodium chloride and magnesium chloride was tested and is reported in Table IV. No advantage could be detected in the use of mixed salts. Indeed, the trend tended to loss of properties overall.

TABLE IV

USE OF MIXED SALTS IN PREPARING DISPERSE SIZE

| Ex. No. | Surfactant Level (% on Rosin) | Salts MgCl (% on Rosin) | Salts NaCl (% on Rosin) | Particle Diameter (μm) | σ | Mechanical Stability (Minutes at 46° C.) | Foam (ml)* |
|---|---|---|---|---|---|---|---|
| 16. | 3.5 | 0.044 | 0.044 | 0.43 | 0.24 | 71 | 40/15 |
| 17. | 3.5 | 0.006 | 0.022 | 0.44 | 0.23 | 64 | 45/15 |
| 18. | 3.5 | 0.022 | 0.066 | 0.42 | 0.19 | — | 40/15 |
| 19. | 3.0 | 0.044 | 0.044 | 0.45 | 0.24 | 88 | 40/10 |

*Highest foam level/Foam level after 30 seconds.

Results with magnesium chloride and sodium chloride, although not perfect, indicated clearly that lower surfactant levels could be achieved with only minimal loss of other properties. In addition, foam seemed to be influenced not only by surfactant level but also by the salt and salt level.

A series of sizes was prepared in which aluminum sulfate was incorporated into the surfactant. The characterizations of those examples appear in Table V. Results superior to those obtained with magnesium or sodium were obtained, both in terms of achievable particle size and foam. A smaller particle diameter could be achieved with aluminum sulfate. Indeed, these Examples demonstrate that a surfactant level of 3.0% is operative for the intended purpose. The foam levels were most encouraging as was the nature of the foam itself. The foam bubbles tended to be larger and more easily broken than they had with other salts. This effect is found to be more important than absolute foam level.

TABLE V

DISPERSE SIZE PRODUCED WITH ALUMINUM SULFATE AS SURFACTANT COFACTOR

| Ex. No | Surfactant Level (% on Rosin) | Aluminum Sulfate Level (% on Rosin) | Particle Diameter (μm) | σ | Mechanical Stability (Monsize ® = 1) | Foam (ml)* |
|---|---|---|---|---|---|---|
| 20. | 4.0 | 0.04 | 0.26 | 0.068 | | |
| 21. | 4.0 | 0.066 | 0.24 | 0.036 | | |
| 22. | 3.5 | 0.044 | 0.28 | 0.098 | 7.1 | 30/15 |
| 23. | 3.5 | 0.044 | 0.27 | 0.08 | 5.0 | 30/10 |
| 24. | 3.5 | 0.033 | 0.28 | 0.09 | | 35/15 |
| 25 | 3.2 | 0.044 | 0.30 | 0.076 | | 25/10 |
| 26. | 3.2 | 0.033 | 0.31 | 0.078 | | 45/15 |
| 27. | 3.2 | 0.044 | 0.30 | 0.069 | | 35/15 |
| 28. | 3.0 | 0.044 | 0.30 | 0.06 | | 30/10 |
| 29. | 3.0 | 0.044 | 0.35 | 0.13 | | 20/10 |
| 30. | 3.0 | 0.044 | 0.34 | 0.16 | | 30/10 |

*Highest foam level/Foam level after 30 seconds.

Aluminum nitrate, calcium chloride, stannous chloride, cobalt nitrate, lead nitrate, and sodium fluoride also were evaluated. Table VI contains data of the results. Each of the salts seemed to have some advantages. Calcium chloride was required in only very small amounts to give reproducibly small particle diameters and good foam results. No grit formation was noted, and the kettles were clean of rosin after inversion. Stannous chloride also gave good results, but the foam tended to be somewhat higher than with other salts. Lead nitrate gave very good results but may be unacceptable for health reasons. Sodium fluoride produced good size and seemed to improve mechanical stability somewhat. Combinations of sodium fluoride/aluminum nitrate were tested after aluminum nitrate showed promise because of its superior foam results. No particular advantage was noted over the individual salts. The salt of choice appeared to be aluminum nitrate at a level of 0.04–0.055% by weight of the rosin at a surfactant level of 3.5% by weight of the rosin. The salt could be most effectively added to the surfactant as an aqueous solution prior to addition of the surfactant to the molten rosin. Addition to either the entire surfactant solution or to the first half of the surfactant solution was seen to be most advantageous. Lower fortification levels, 9% vs. 10% were determined to be preferable and that trend was maintained. As with aluminum sulfate the character of foam bubbles was changed to larger, faster breaking.

Four plant runs using aluminum nitrate and 3.5% surfactant were made.

The results are listed in Table VII. In Table VIII float and foam results are shown. The foam results are a striking improvement over Stafor ® with 4.5% surfactant. The float results show a much closer resemblance to Neuphor ® and Monsize ®. Although the significance of floating pulp is poorly understood, the presence of floating pulp may correlate with foam problems on paper machines. Sizing results are shown in Table IX. Little sizing difference was seen between improved lower surfactant Stafor ® and 4.5% surfactant Stafor ®.

TABLE VI

EFFICACY OF VARIOUS SALTS IN SIZE PRODUCTION AT 3.5% SURFACTANT LEVEL

| Ex. No. | Salt | % Salt on Weight of Rosin | Percent Fortification | Mechanical Stability (Monsize ® = 1) | Dμ | σ | Foam (ml)** |
|---|---|---|---|---|---|---|---|
| 31. | $CaCl_2$ | 0.033 | 10 | 10 | 0.35 | 0.12 | 35/10 |
| 32. | $CaCl_2$ | 0.022 | 10 | 10 | 0.32 | 0.07 | 25/10 |
| 33. | $CaCl_2$ | 0.011 | 10 | 10 | 0.29 | 0.17 | |
| 34. | $CaCl_2$ | 0.011 | 10 | 10 | 0.28 | 0.07 | 60/10 |
| 35. | $CaCl_2$ | 0.011 | 10 | 10 | 0.27 | 0.07 | |
| 36. | $Co(NO_3)_2$ | 0.1 | 10 | 10 | 0.36 | 0.17 | 35/10 |
| 37. | $Co(NO_3)_2$ | 0.066 | 10 | 10 | 0.31 | 0.09 | 35/15 |
| 38. | $Pb(NO_3)_2$ | 0.05 | 10 | 10 | 0.26 | 0.05 | 30/10 |
| 39. | $Pb(NO_3)_2$ | 0.04 | 10 | 10 | 0.28 | 0.08 | 25/75 |
| 41. | $SnCl_2$ | 0.033 | 10 | 10 | 0.29 | 0.07 | 20/10 |
| 42. | $SnCl_2$ | 0.022 | 10 | 10 | 0.29 | 0.01 | 45/10 |
| 43. | $SnCl_2$ | 0.022 | 10 | 10 | 0.28 | 0.07 | 45/10 |
| 44. | $SnCl_2$ | 0.022 | 10 | 10 | 0.29 | 0.08 | 50/10 |
| 45. | NaF | 0.05 | 10 | 10 | 0.29 | 0.10 | 45/15 |
| 46. | NaF | 0.03 | 10 | 10 | 0.28 | 0.08 | 25/10 |
| 47. | NaF | 0.03 | 8 | 10 | 0.26 | 0.09 | 45/10 |
| 48. | $Al(NO_3)_3$ | 0.04 | 10 | 10 | 0.29 | 0.08 | 20/10 |
| 49. | $Al(NO_3)_3$ | 0.033 | 10 | 10 | 0.29 | 0.06 | 40/10 |
| 50. | $Al(NO_3)_3$ | 0.022 | 10 | 10 | 0.27 | 0.07 | 25/15 |
| 51. | $Al(NO_3)_3$ | 0.022 | 10 | 3.7 | 0.26 | 0.09 | 40/15 |
| 52. | $Al(NO_3)_3$ | 0.055 | 9 | 10 | 0.30 | 0.07 | 25/5 |
| 53. | $Al(NO_3)_3$ | 0.04 | 9 | 10 | 0.25 | 0.09 | 20/10 |
| 54. | $Al(NO_3)_3$ | 0.04 | 8 | 10 | 0.26 | 0.08 | 30/10 |
| 55. | $Al(NO_3)_3$/NaF | 0.033/0.01 | 10 | 10 | 0.29 | 0.09 | 30/15 |

TABLE VI-continued

| Ex. No. | Salt | % Salt on Weight of Rosin | Percent Fortification | Mechanical Stability (Monsize ® = 1) | Dμ | σ | Foam (ml)** |
|---|---|---|---|---|---|---|---|
| | | EFFICACY OF VARIOUS SALTS IN SIZE PRODUCTION AT 3.5% SURFACTANT LEVEL | | | | | |
| 56. | $Al(NO_3)_3$/NaF | 0.033/0.02 | 10 | 10 | 0.29 | 0.09 | 30/10 |

**Highest foam level/Foam level after 30 seconds.

TABLE VII

| CHARACTERIZATION OF Sample | Dμ | σ | PLANT SIZE BATCHES Mechanical Stability (Minutes @ 46° C.) | Foam (ml)** |
|---|---|---|---|---|
| UTLX67531 | 0.30 | 0.09 | 1031 | 15/5 |
| UTLX67549 | 0.28 | 0.09 | 265+ | 15/5 |
| TILX220011 | 0.28 | 0.10 | 270+ | 20/5 |
| Run #3-53 | 0.31 | 0.09 | —* | 20/5 |

*Sample not run due to laboratory filtration problems.
**Highest foam level/Foam level after 30 seconds.

TABLE VIII

| FLOAT AND FOAM PROPERTIES OF Sample | Float* 20 min | Float* 40 min | PLANT MATERIAL Foam (ml)** |
|---|---|---|---|
| (4.5% surfactant) Stafor | 80 ↑ | 110 ↑ | 80/20 |
| A | 0 | 0 | 15/5 |
| B | 0 | 0 | 15/5 |
| C | 0 | 0 | 15/5 |
| D | — | — | 15/5 |
| Neuphor ® | 30 ↓ | 30 ↓ | 25/10 |
| Monsize ® | 20 ↓ | 40 ↓ | 15/5 |
| Untreated | 20 ↓ | 30 ↓ | — |

*Clear volume rise or sink in 2,000 ml sample.
**Highest foam level/Foam level after 30 seconds.

TABLE IX

| | SIZING (HST) Beater Run A 1% in* Dist. Water | Beater Run A 3% in* Cov. Water | Beater Run B 1% in* Dist. Water | Beater Run B 3% in* Cov. Water | Beater Run C 1% in* Dist. Water |
|---|---|---|---|---|---|
| 4.5% Stafor | 283 | 215 | 191 | 145 | 249 |
| A Stafor ® | — | — | 187 | 145 | 160 |
| C Stafor ® | — | — | 163 | — | 152 |
| $CaCl_2$ | — | — | — | — | 205 |
| NaF | — | — | — | — | 145 |
| Alum | 204 | 257 | — | — | — |
| $Al(NO_3)_3$ | 385 | 214 | 241 | — | — |
| Neuphor ® | 296 | 246 | — | 203 | 203 |
| Monsize ® | 177 | 230 | — | 194 | 174 |

*1% Dilution in distilled water or 3% dilution in tap water.

What is claimed:

1. In a process for preparing an aqueous dispersion of a rosin-base material by mixing together a melt of the rosin-base material, a surfactant and water to obtain a dispersion comprising a continuous phase of the rosin-base material and a dispersed phase of the water, and adding water to the dispersion to invert the dispersioan to the contemplated aqueous dispersion comprising a dispersed phase of the rosin-base material and a continuous phase of the water, the improvement comprising the step of adding an inorganic salt to at least a portion of the surfactant prior to addition of the surfactant to the melt of the rosin-base material, said salt being added in an amount sufficient to lower the foaming tendency of the aqueous dispersion whereby a generally reduced level of surfactant is required to establish the aqueous dispersion.

2. A process as defined in claim 1 wherein the inorganic salt is selected from the group comprising chlorides, fluorides, nitrates and sulfates of aluminum, calcium, cobalt, lead, sodium and tin.

3. A process as defined in claim 1 wherein the inorganic salt is selected from the group comprising calcium chloride, magnesium chloride, sodium chloride, stannous chloride, sodium chloride, sodium fluoride, aluminum nitrate, cobalt nitrate, lead nitrate, aluminum sulfate and mixtures thereof.

4. A process as defined in claim 1 wherein the surfactant is at least one salt of sulfuric acid half ester represented by the formula

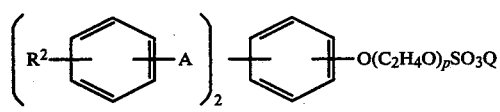

wherein $R^2$ is hydrogen or lower alkyl, A is straight-chain or branched-chain alkylene having 2 to 3 carbon atoms, p is an interger of 4 to 25, and Q is a monovalent cation.

5. A process as defined in claim 4 wherein $R^2$ is hydrogen, A is a branched-chain alkylene having 3 carbon atoms, p is 13, and Q is a monovalent cation.

6. A process as defined in claim 1 wherein the surfactant level is in the order of about 2.5% to about 4.0% by weight of the rosin-base material, the inorganic salt is present in the order of about 0.011% to about 0.1% by weight of the rosin-base material and the rosin-base material is fortified in the order of about 8% to about 10% by weight.

7. A process as defined in claim 6 wherein the surfactant level is about 3.5% and the inorganic salt is present at about 0.04% to about 0.055%.

8. A process as defined in claim 4 wherein the surfactant level is about 3.5% by weight of the rosin-base material and the inorganic salt comprises aluminum nitrate at about 0.04% to about 0.055% by weight of the rosin-base material.

9. An aqueous dispersion of a rosin-base material produced by the process of claim 1, 2, 3, 4, 5, 6, 7 or 8.

10. A cellulosic web sized with the aqueous dispersion of a rosin-base material produced by the process of claim 1, 2, 3, 4, 5, 6, 7 or 8.

* * * * *

UNITED STATES PATENT AND TRADEMARK OFFICE

CERTIFICATE OF CORRECTION

PATENT NO. : 4,461,646

DATED : July 24, 1984

INVENTOR(S) : John W. Gowan, Jr.

It is certified that error appears in the above-identified patent and that said Letters Patent is hereby corrected as shown below:

In column 2, line 8, "sheet" should read --sheer--.

In column 3, line 61, "3,267,099" should read --4,267,099--.

In column 4, line 18, "form" should read --foam--.

In column 6, line 9 from the top of Table IV,
"17. 3.5 0.006 0.022 0.44 0.23 64 45/15" should read
--17. 3.5 0.066 0.022 0.44 0.23 64 45/15--.

In column 8, line 16 from the top of Table VI,
"39. $Pb(NO_3)_2$ 0.04 10 10 0.28 0.08 25/75" should read
--39. $Pb(NO_3)_2$ 0.04 10 10 0.26 0.06 40/10--.

In column 8, after line 16 from the top of Table VI, the data line
--40. $Pb(NO_3)_2$ 0.04 10 10 0.28 0.08 25/7.1-- should be inserted.

Signed and Sealed this

*Twentieth* Day of *August 1985*

[SEAL]

*Attest:*

DONALD J. QUIGG

*Attesting Officer* *Acting Commissioner of Patents and Trademarks*